US006831253B2

(12) United States Patent
Taniguchi et al.

(10) Patent No.: US 6,831,253 B2
(45) Date of Patent: Dec. 14, 2004

(54) CERAMIC GLOW PLUG AND STRUCTURE FOR MOUNTING THE SAME ONTO CYLINDER HEAD

(75) Inventors: Masato Taniguchi, Aichi (JP); Takayuki Otani, Aichi (JP)

(73) Assignee: NGK Spark Plug Co., Ltd., Aichi (JP)

( * ) Notice: Subject to any disclaimer, the term of this patent is extended or adjusted under 35 U.S.C. 154(b) by 53 days.

(21) Appl. No.: 10/097,594

(22) Filed: Mar. 15, 2002

(65) Prior Publication Data

US 2002/0130121 A1 Sep. 19, 2002

(30) Foreign Application Priority Data

Mar. 16, 2001 (JP) ..... 2001-077151

(51) Int. Cl.[7] ..... F23Q 7/00
(52) U.S. Cl. ..... 219/270; 123/145 A
(58) Field of Search ..... 219/270, 544; 123/145 A, 145 R

(56) References Cited

U.S. PATENT DOCUMENTS 4,346,679 A * 8/1982 Knowles ..... 123/145 A
4,525,622 A * 6/1985 Kawamura et al. ..... 219/270
5,084,607 A * 1/1992 Shafer et al. ..... 219/270
6,248,980 B1 * 6/2001 Chiu et al. ..... 219/270
6,285,007 B1 * 9/2001 Chiu et al. ..... 219/270
6,512,204 B1 * 1/2003 Chiu et al. ..... 219/270

FOREIGN PATENT DOCUMENTS

| | | | |
|---|---|---|---|
| GB | 861842 | * 3/1961 | |
| JP | 6-288333 | * 10/1994 | ..... 123/145 R |
| SE | 82987 | * 3/1935 | ..... 123/145 A |

* cited by examiner

*Primary Examiner*—John A. Jeffery
(74) *Attorney, Agent, or Firm*—Sughrue Mion, PLLC

(57) ABSTRACT

A glow plug in which a ceramic heater is fixedly disposed in a metallic, cylindrical member such that a front end thereof projects from a front end of the cylindrical member, and the resultant cylindrical member is fixedly disposed in a plug body such that the front end of the cylindrical member projects from a front end of the body, and which readily provides a mounting structure such that, even when loosening arises at a joint between the body and the cylindrical member after the glow plug is mounted onto a cylinder head, the cylindrical member is prevented from dropping into the interior of an engine.

10 Claims, 11 Drawing Sheets

CERAMIC GLOW PLUG AND STRUCTURE FOR MOUNTING THE SAME ONTO CYLINDER HEAD

BACKGROUND OF THE INVENTION

1. Field of the Invention

The present invention relates to a ceramic glow plug used for accelerating start-up of a diesel engine or a like application.

2. Description of the Related Art

FIG. 9 shows a ceramic glow plug 1 for use in a diesel engine. The ceramic glow plug 1 is configured in the following manner: a round-bar-like (columnar) ceramic heater 2 is fixedly fitted into the interior (cylindrical bore) of a straight tubular, metallic, cylindrical member 3 such that a heater end 2*a* projects from a front end 3*a* of the metallic, cylindrical member (hereinafter may be referred to as merely a cylindrical member) 3; and the resultant assembly consisting of the ceramic heater 2 and the cylindrical member 3 is fixedly fitted into (united with) a metallic, cylindrical plug body (hereinafter also referred to as merely a plug body or body) 4 such that the front end 3*a* of the cylindrical member 3 projects from a front end 4*a* of the body 4. The cylindrical member 3 used in this structure serves as a cover for protecting the ceramic heater 2 from various external forces (impact induced by dropping, a bending force applied in the course of mounting on an engine, etc.) that may be imposed on the ceramic heater 2 in the course of manufacture of the glow plug 1 and handling of the manufactured glow plug 1.

Such a ceramic glow plug 1 is usually assembled in the following manner. First, the ceramic heater 2 is loosely fitted into the cylindrical member 3, and a molten brazing metal (not shown) is poured into the gap therebetween. Thermal expansion of the cylindrical member 3 induced by the poured, molten brazing metal and contraction of the cylindrical member 3 induced by cooling are utilized for hermetically fixing the ceramic heater 2 in the cylindrical member 3 through squeezing action of the cylindrical member 3. Similarly, the assembly consisting of the ceramic heater 2 and the cylindrical member 3, together with other necessary components, is loosely fitted into the body 4, and a molten brazing metal is poured into the gap therebetween (brazing), thereby completing assembly. Instead of employing such brazing, the assembly consisting of the ceramic heater 2 and the cylindrical member 3 may be press-fitted into the body 4. However, this method is not put into practical use, because of a drawback described below.

As shown in FIGS. 9 and 10, the thus-assembled glow plug 1 is mounted onto a cylinder head 101 of a diesel engine via a threaded portion 6 formed on the outer circumferential surface of the body 4. Specifically, as shown in FIGS. 9 and 10, a mounting bore 104 for mounting the glow plug 1, the mounting bore 104 communicating with a prechamber 103, is provided on the cylinder head 101. The glow plug 1 is inserted from its end into the mounting bore 104. The threaded portion 6 of the body 4 is engaged with a threaded portion 105 formed in the mounting bore 104 such that the heater end 2*a* partially projects into the prechamber 103.

The mounting bore 104 is configured in the following manner. In order to mount the plug body 4 while a seal is established at the front end 4*a* of a cylindrical portion 7 of the plug body 4, a cylindrical bore 106 formed at a deep location of the mounting bore 104 allows the cylindrical portion 7 to be loosely fitted thereinto. Additionally, the front end 4*a* of the cylindrical portion 7 is located at a deep location of the cylindrical bore 106 and pressed against a dead end portion 107, whose bore diameter is smaller than the thread diameter. A cylindrical, small bore 108, whose diameter is equal to the bore diameter of the dead end portion 107, is formed at a location deeper than the dead end portion 107. The cylindrical member 3 is disposed in the cylindrical, small bore 108 in a loosely fit condition.

3. Problems to be Solved by the Invention

When current is applied to the thus-mounted glow plug 1 via electricity supply leads 15 and 16, a heating member embedded in the ceramic heater 2 generates heat through resistance to thereby accelerate start-up of an engine. The ceramic heater 2 is exposed to significant temperature variations (thermal shock) and blast waves during combustion of the engine. In the course of use, vibration and temperature rise may cause loosening at a joint between the cylindrical member 3 and the body 4. Such loosening potentially causes the cylindrical member 3 united with the ceramic heater 2 to drop off the inner circumferential surface of the body 4 into the prechamber 103.

Such a problem may arise even when the cylindrical member 3 united with the ceramic heater 2 is press-fitted into the body 4. When the cylindrical member 3 and the body 4 are to be joined together by press fitting, the cost of a glow plug can be lowered as compared with the case where the cylindrical member 3 and the body 4 are joined by brazing. This is because placement of a brazing metal and design to endure brazing temperature are not involved. In order to prevent breakage of the ceramic heater 2, which may result from stress concentration at the time of press fit, the tolerance of press fit must be reduced. However, a reduction in the tolerance of press fit increases the possibility of drop-off, and this is the reason why the press fit method is not put into practical use.

SUMMARY OF THE INVENTION

The present invention has been accomplished in view of the above-described problems involved in a conventional glow plug. It is therefore an object of the present invention to realize a structure for mounting a glow plug on a cylinder head, the structure preventing an assembly consisting of a cylindrical member and a ceramic heater from dropping off a body and entering an engine (prechamber), regardless of the means employed for joining the body and the cylindrical member, even when looseness arises in a joint between the body and the cylindrical member in the course of use of a glow plug mounted on the cylinder head.

The above object has been achieved in a first aspect of the invention by providing a ceramic glow plug in which a ceramic heater is fixedly disposed in a metallic, cylindrical member such that a front end thereof projects from a front end of the metallic, cylindrical member, and a resultant assembly consisting of the ceramic heater and the metallic, cylindrical member is fixedly disposed in a metallic, cylindrical plug body such that the front end of the metallic, cylindrical member projects from a front end of the metallic, cylindrical plug body.

The ceramic glow plug is characterized in that a portion of the metallic, cylindrical member which projects from the front end of the metallic, cylindrical plug body and extends over a predetermined range from the front end of the metallic, cylindrical member toward a rear end of the metallic, cylindrical member is smaller in outside diameter than a portion of the metallic, cylindrical member which is fixedly disposed within the metallic, cylindrical plug body, and that a front-end-oriented end face is formed in a diameter transition region of the metallic, cylindrical member where the outside diameter changes between those of the two portions.

According to the present invention, the above-described front-end-oriented end face is formed on the cylindrical member, thereby preventing entry of the cylindrical member into the cylinder head (prechamber) when the ceramic glow plug is mounted in a glow plug mounting bore (hereinafter also referred to merely as a mounting bore) formed in the cylinder head. Specifically, as described above, the ceramic glow plug is mounted onto the cylinder head via a threaded portion formed on an outer circumferential surface of the plug body so as to be screwed into a threaded portion of a ceramic glow plug mounting bore formed in the cylinder head until the front end of the plug body is pressed against a dead end portion (seat face) located at a deep location of the mounting bore and having a bore diameter smaller than a thread diameter of the threaded portion of the mounting bore. Therefore, in this mounting structure, entry of the cylindrical member into the cylinder head can be prevented in the following manner: movement prevention means is provided in the mounting bore for preventing movement of the front-end-oriented end face deep into the mounting bore so as to prevent the metallic, cylindrical member from moving deep into the mounting bore and into the interior of the cylinder head. That is, in the present invention, a structural feature may be formed in the mounting bore which the front-end-oriented end face abuts so as to prevent entry of the metallic, cylindrical member into the interior of the prechamber. Thus, the present invention can easily and reliably prevent a serious accident, such as an accident arising conventionally in which the cylindrical member that holds the ceramic heater separates from the body and drops into the cylinder head due to loosening at the joint between the body and the cylindrical member.

A portion of the metallic, cylindrical member which projects from the front end of the metallic, cylindrical plug body and is smaller in outside diameter than a portion of the metallic, cylindrical member fixedly disposed within the metallic, cylindrical plug body may extend over a predetermined range from the front end of the metallic, cylindrical member toward a rear end of the metallic, cylindrical member. Therefore, the small-diameter portion of the metallic, cylindrical member may be the entire portion which projects from the front end of the metallic, cylindrical plug body, or may be most of or part of the projecting portion which extends from the front end toward the rear end. Preferably, in the above-described means to solve the problems of the prior art, as described in a second aspect of the invention, the front-end-oriented end face formed in the diameter transition region of the metallic, cylindrical member and the front end of the metallic, cylindrical plug body are substantially aligned with each other in the axial direction of the ceramic heater. In this manner, when the small-diameter portion of the metallic, cylindrical member is substantially the entire portion which projects from the front end of the metallic, cylindrical plug body, the movement prevention means for preventing movement of the front-end-oriented end face deep into the mounting bore can be implemented by rendering the bore diameter of the dead end portion of the mounting bore smaller than the outside diameter of the large-diameter portion having a relatively large diameter and being located on the side toward the rear end with respect to the front-end-oriented end face, thereby avoiding a complex mounting structure. Preferably, when the front-end-oriented end face is to be substantially aligned with the front end of the metallic, cylindrical plug body, the front-end-oriented end face is shifted slightly toward the rear end from the front end of the plug body. As a result, by rendering the bore diameter of the dead end portion smaller than the outside diameter of the large-diameter portion of the cylindrical member, a seal is established at the interface between the end of the body and the dead end portion.

A third aspect of the present invention is a ceramic glow plug described in the above first or second aspects, the ceramic glow plug being characterized in that the difference in outside diameter between a small-diameter portion of the metallic, cylindrical member and a large-diameter portion of the metallic, cylindrical member is not less than 0.3 mm, the small-diameter portion having a relatively small diameter and being located on a side toward the front end with respect to the front-end-oriented end face, which is formed in the diameter transition region of the metallic, cylindrical member, and the large-diameter portion having a relatively large diameter and being located on a side toward the rear end with respect to front-end-oriented end face.

Employing a difference of not less than 0.3 mm in outside diameter between the large-diameter portion and the small-diameter portion as described in the above third aspect facilitates design of the movement prevention means for preventing movement of the front-end-oriented end face deep into the mounting bore. In view of reliable prevention of movement, a greater difference in diameter is preferred. However, an excessively great difference in diameter is accordingly accompanied by an increase in the wall thickness of the large-diameter portion of the cylindrical member or decrease in the wall thickness of the small-diameter portion. In view of these drawbacks, an appropriate difference in diameter is 0.5–2 mm.

In the above-described means for solving the problems of the prior art, the metallic, cylindrical member may be press-fitted into the metallic, cylindrical plug body as described in a fourth aspect of the invention, or the metallic, cylindrical member may be fixedly disposed in the metallic, cylindrical plug body via a brazing metal (hereinafter this process is also referred to as brazing) as described in a fifth aspect of the invention. Because of use in the aforementioned severe environment, a conventional glow plug may suffer separation of the cylindrical member and the body even when either fixation structure is employed. The present invention can easily solve these problems when either fixation structure is employed. Particularly, the present invention allows practical use of fixation by press fitting, which has conventionally encountered difficulty in being put into practical use. This is because dimensional tolerance of the press fit can be alleviated, thereby realizing a low-cost glow plug.

A structure for mounting a ceramic glow plug on a cylinder head as described in a sixth aspect of the invention is configured in the following manner. A ceramic glow plug-in which a ceramic heater is fixedly disposed in a metallic, cylindrical member such that a front end thereof projects from a front end of the metallic, cylindrical member, and a resultant assembly consisting of the ceramic heater and the metallic, cylindrical member is fixedly disposed in a metallic, cylindrical plug body such that the front end of the metallic, cylindrical member projects from a front end of the metallic, cylindrical plug body-is mounted onto a cylinder head via a threaded portion formed on an outer circumferential surface of the metallic, cylindrical plug body so as to be screwed into a threaded portion of a ceramic glow plug mounting bore formed in the cylinder head until the front end of the metallic, cylindrical plug body is pressed against a dead end portion located at a deep location of the mounting bore and having a bore diameter smaller than a thread diameter of the threaded portion of the mounting bore.

The structure for mounting a ceramic glow plug on a cylinder head is characterized in that a portion of the metallic, cylindrical member which projects from the front end of the metallic, cylindrical plug body and extends over a predetermined range from the front end of the metallic, cylindrical member toward a rear end of the metallic, cylindrical member is smaller in outside diameter than a portion of the metallic, cylindrical member which is fixedly disposed within the metallic, cylindrical plug body, and a front-end-oriented end face is formed in a diameter transition region of the metallic, cylindrical member where the outside diameter changes between those of the two portions.

The structure for mounting a ceramic glow plug on a cylinder head is further characterized in that movement prevention means is provided in the mounting bore for preventing movement of the front-end-oriented end face deep into the mounting bore so as to prevent the metallic, cylindrical member from moving deep into the mounting bore and into interior of the cylinder head.

A structure for mounting a ceramic glow plug on a cylinder head as described in a seventh aspect of the invention is configured such that, in the sixth aspect, the movement prevention means is implemented by rendering the bore diameter of the dead end portion of the mounting bore smaller than an outside diameter of a large-diameter portion having a relatively large diameter and being located on a side toward the rear end with respect to the front-end-oriented end face.

A structure for mounting a ceramic glow plug on a cylinder head as described in an eighth aspect of the invention is configured such that, in the sixth aspect, the movement prevention means is implemented by rendering a diameter of the mounting bore as measured at a location located deeper than the dead end portion smaller than an outside diameter of a large-diameter portion having a relatively large diameter and being located on a side toward the rear end with respect to the front-end-oriented end face.

DESCRIPTION OF REFERENCE NUMERALS

Figure 1:
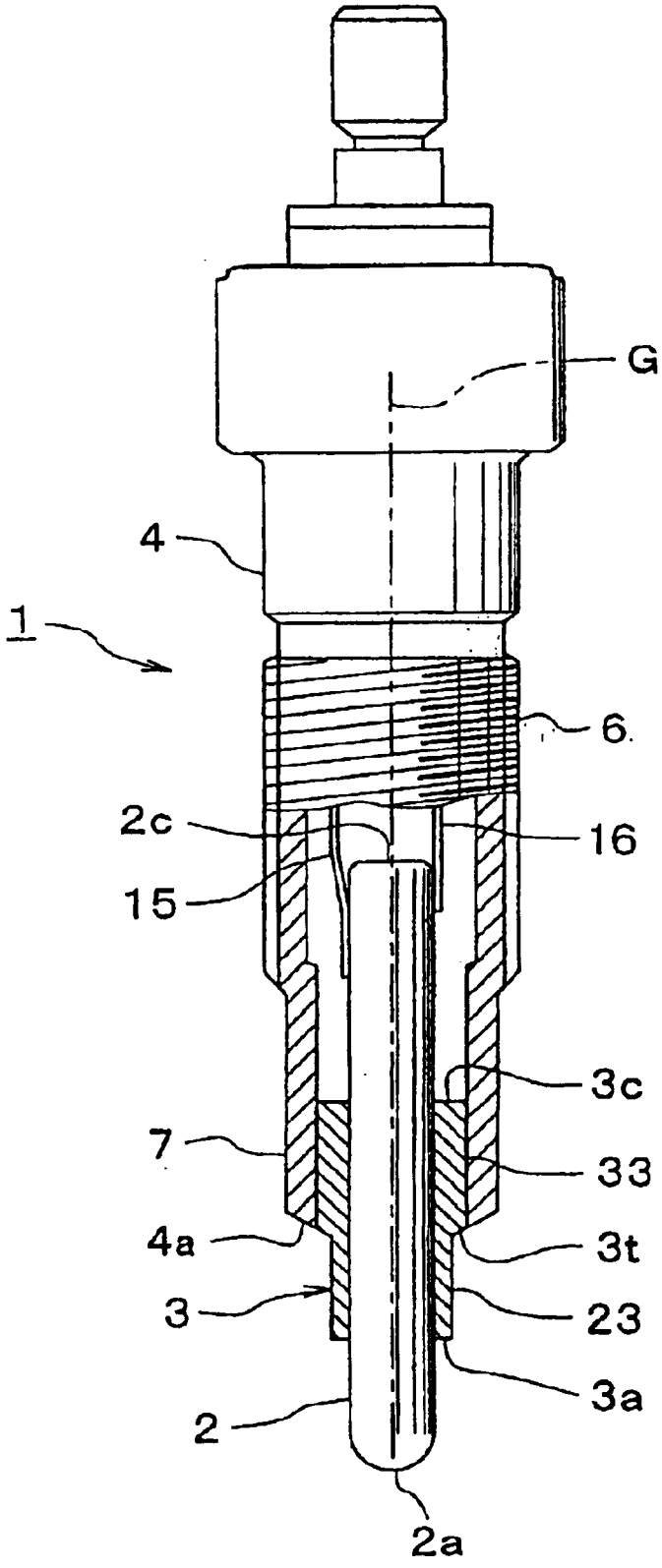
FIG. 1 is a front longitudinal view partly in section showing a first embodiment of a glow plug according to the present invention.
Figure 2:
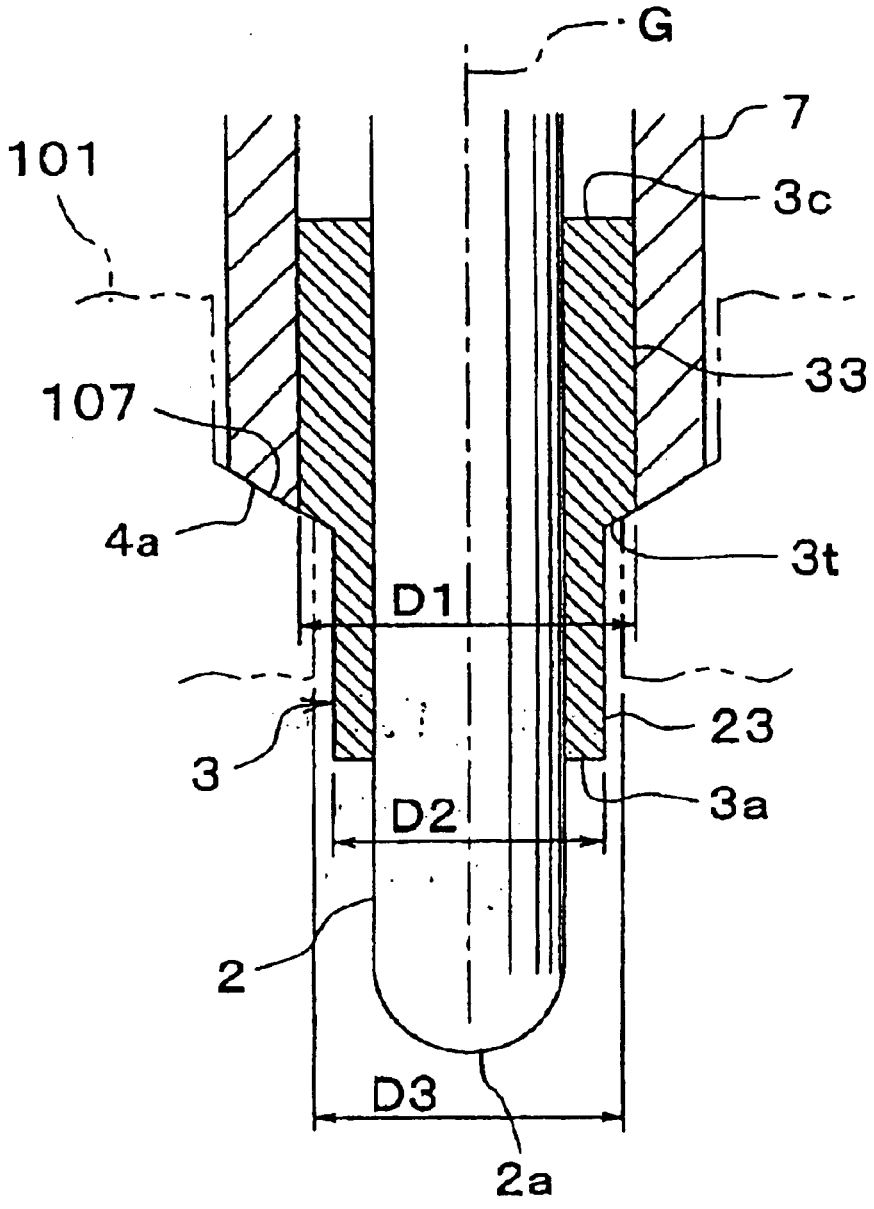
FIG. 2 is an enlarged view showing essential portions of FIG. 1.

1: ceramic glow plug
2: ceramic heater
2*a*: heater end
3: metallic, cylindrical member
3*a*: front end of metallic, cylindrical member
3*t*: front-end-oriented end face of metallic, cylindrical member
4: metallic, cylindrical plug body
4*a*: front end of metallic, cylindrical plug body
6: threaded portion formed on outer circumferential surface of the metallic, cylindrical plug body
100: cylinder
101: cylinder head
103: prechamber
104: mounting bore
105: threaded portion of mounting bore
107: dead end portion (movement prevention means)
110: rear-end-oriented end face (movement prevention means)
D1: outside diameter of large-diameter portion of the metallic, cylindrical member
D2: outside diameter of small-diameter portion of metallic, cylindrical member
D3: bore diameter of dead end portion in mounting bore
D4: diameter of portion of mounting bore located deeper than the dead end portion
G: axis of ceramic heater

DESCRIPTION OF THE PREFERRED EMBODIMENTS

The invention will now be described by reference to the drawings. However, the present invention should not be construed as being limited thereto.

A first embodiment of the present invention will next be described in detail with reference to FIGS. 1 to 4. In the drawings, reference numeral 1 denotes a ceramic glow plug. The ceramic glow plug 1 is configured in the following manner: a round-bar-like (columnar) ceramic heater 2 is loose fitted into the interior (a cylindrical bore) of a tubular, metallic, cylindrical member 3 such that a front end 2*a* projects from a front end 3*a* of a metallic, cylindrical member (hereinafter also referred to as a cylindrical member) 3, and a rear end 2*c* projects from a rear end 3*c* of the cylindrical member 3; and a brazing metal is interposed therebetween for fixing the two components. The ceramic heater 2 is configured such that an unillustrated heating member is embedded in a ceramic substrate formed of silicon nitride. When current is applied to the heating member connected to electricity supply leads 15 and 16, the heating member generates heat through resistance heating.

The metallic, cylindrical member 3, in which the ceramic heater 2 is fixedly disposed, is press-fitted into, for example, a diametrally reduced, straight tubular, cylindrical portion 7 of a stepped metallic, cylindrical plug body 4 as shown in FIG. 1, the portion 7 being located on the side toward a front end 4*a*, such that a portion of the cylindrical member 3 located on the side toward the front end 3*a* projects from the front end 4*a* of the cylindrical portion 7. The front end 4*a* of the cylindrical portion 7, which is a front end of the plug body 4, is steeply tapered down. The body 4 includes a threaded portion 6, which is formed on the outer circumferential surface of an intermediate portion thereof extending along axis G. The body 4 is mounted onto a cylinder head such that the threaded portion 6 thereof is screwed into a threaded portion of a mounting bore formed in the cylinder head. This configuration is similar to that of a conventional glow plug.

According to the present embodiment, a portion (a small-diameter portion) 23 of the cylindrical member 3 which projects from the front end 4*a* of the plug body 4 is smaller in outside diameter than a portion (a large-diameter portion) 33 which is fixedly disposed within the plug body 4 and is concentric with the portion 23; specifically, outside diameter D2 of the portion 23 is smaller than outside diameter D1 of the portion 33. An annular front-end-oriented end face 3*t* is formed in a diameter transition region where the outside diameter changes between outside diameters D2 and D1. In the present embodiment, the front-end-oriented end face 3*t* is tapered in the same manner as is the front end 4*a* of the cylindrical portion 7, whereby the two end faces 3*t* and 4*a* form a single taper surface.

That is, in the present embodiment, the annular front-end-oriented end face 3*t*, which is formed in the diameter transition region of the metallic, cylindrical member 3 is aligned, in the direction of axis G of the ceramic heater 2, with the front end 4*a* of the plug body 4 in the form of a taper surface.

Figure 5:
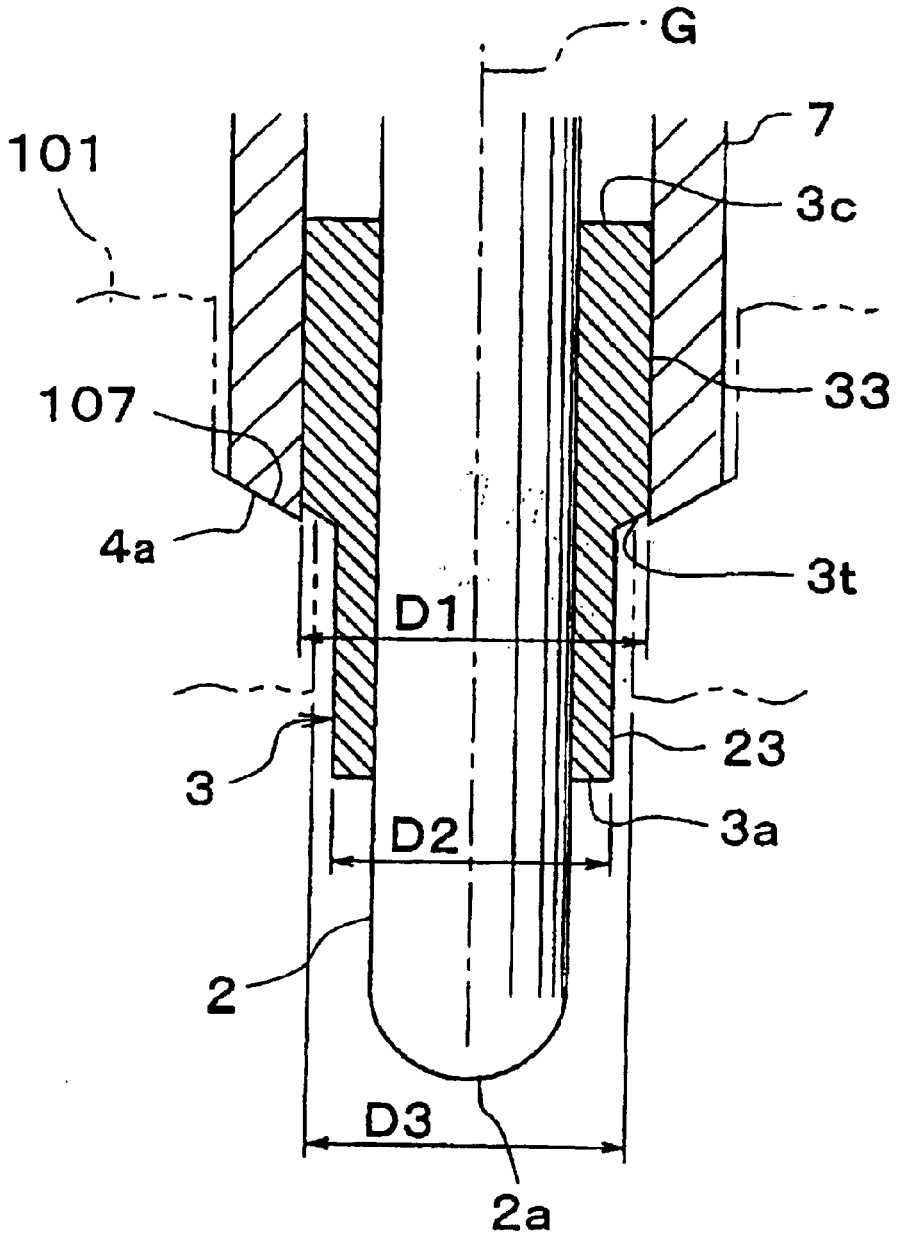
FIG. 5 is an enlarged sectional view showing a improved variation of the first embodiment shown in FIG. 2.

In a preferred modification, the annular front-end-oriented end face 3*t* can be disposed within the plug body 4, that is the front-end-oriented end face 3*t* is preferably shifted toward the rear end from the front end of the plug body. More preferably, the annular front-end-oriented end face 3*t* can be disposed within the tapered front end 4*a* of the plug body 4 as shown in FIG. 5. This is because such structure can prevent a pressure concentration at the front end of the front-end-oriented end face 3*t*.

Notably, in the present embodiment, the large-diameter portion 33, which is located on the side toward the rear end with respect to the front-end-oriented end face 3*t* and has a relatively large diameter, has an outside diameter D1 of 6 mm; and the small-diameter portion 23, which is located on the side toward the front end with respect to the front-end-oriented end face 3*t* and has a relatively small diameter, has an outside diameter D2 of 5 mm. The difference between D1 and D2 is 1 mm.

The cylindrical member 3 in the present embodiment is formed of SUS430 defined by JIS G 4308 (1981) and joined with the ceramic heater 2 in the following manner. The ceramic heater 2 is loosely fitted into the cylindrical member 3, and a molten brazing metal (not shown) is poured into the gap therebetween. Thermal expansion of the cylindrical member 3 induced by the poured, molten brazing metal and contraction of the cylindrical member 3 induced by cooling are utilized for hermetically fixing the ceramic heater 2 in the cylindrical member 3 through squeezing action of the cylindrical member 3. The body 4 is formed of a steel equivalent to S40C defined in JIS G 4051 (1979), such as STKM16 defined by JIS G 3445 (1983). The large-diameter portion 33, located on the side toward the rear end, of the cylindrical member 3 united with the ceramic heater 2 is press-fitted at a press fit tolerance of 10 $\mu$m (as measured diametrally) into the cylindrical portion 7 of the body 4 until the front-end-oriented end face 3*t* formed in the diameter transfer region thereof is aligned with the taper of the front end 4*a* of the body 4, to thereby be fixed on the inner circumferential surface of the cylindrical portion 7.

Figure 3:
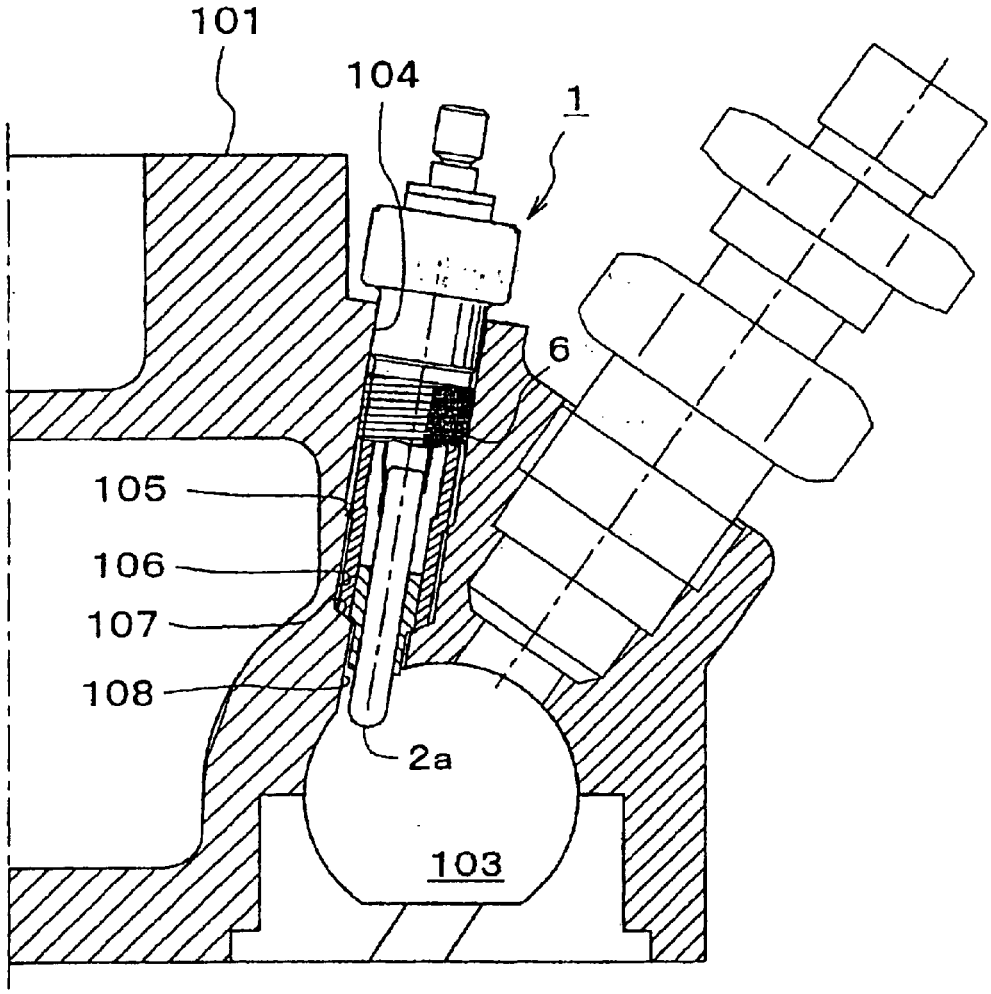
FIG. 3 is an explanatory view showing a state in which the glow plug of FIG. 1 is mounted on a cylinder head.

As shown in FIG. 3, the thus-configured glow plug 1 of the present embodiment is mounted onto a cylinder head 101 of a diesel engine via the thread portion 6 formed on the outer circumferential surface of the body 2. As shown in FIG. 3, the cylinder head 101 has the glow plug mounting bore 104 formed therein in such a manner as to extend therethrough to the prechamber 103. The glow plug 1 is inserted, from its front end, into the mounting bore 104 and screw-engaged with the threaded portion 105 of the mounting bore 104 via the threaded portion 6 formed on the outer circumferential surface of the body 4 to thereby be mounted. In order to achieve this mounting, the following structural feature is employed.

Figure 4:
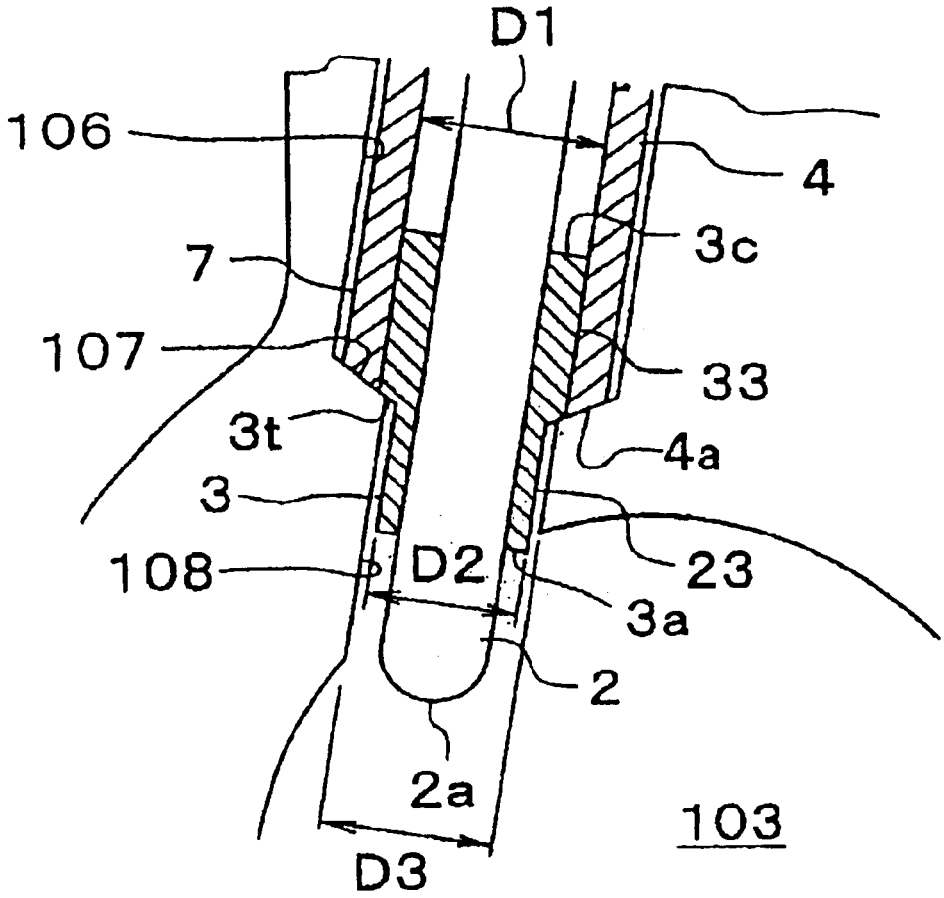
FIG. 4 is an enlarged view showing essential portions of FIG. 3.

The mounting bore 104 has the threaded portion 105, into which the threaded portion 6 of the body 4 can be screwed. As shown in FIG. 4, at a location located deeper than the threaded portion 105, the mounting bore 104 has a cylindrical bore 106, into which the cylindrical portion 7, located on the side toward the front end 4*a*, of the body 4 can be loosely fitted. At a deep location, the cylindrical bore 106 has a dead end portion 107, whose bore diameter is smaller than the thread diameter of the threaded portion 105 and which assumes the form of an annular tapered seat face. The dead end portion 107 is tapered in the same manner as are the body front end 4*a* and the front-end-oriented end face 3*t* of the cylindrical member 3, thereby allowing the front end 4*a* and the front-end-oriented end face 3*t* to abut the same. At a location deeper than the dead end portion 107, a cylindrical, small bore 108 is formed concentric with the cylindrical bore 106. The cylindrical, small bore 108 has diameter D3 which is smaller than the diameter of the cylindrical bore 106 and slightly larger than outside diameter D2 of the small-diameter portion 23 of the cylindrical member 3. Diameter D3 of the cylindrical, small bore 108 is set about 5.8 mm, smaller than outside diameter D1 of the large-diameter portion 33 of the cylindrical member 3 and larger than outside diameter D2 of the small-diameter portion 23.

The glow plug 1 is inserted, from its front end 2*a*, into the mounting bore 104. The threaded portion 6 formed on the outer circumferential surface of the body 4 is screwed into the threaded portion 105 of the mounting bore 104, whereby the glow plug 1 is mounted in the mounting bore 104. At this time, as will be understood from the above-described dimensional relations, the front end 4*a* of the cylindrical portion 7 of the body 4 and the front-end-oriented end face 3*t* of the cylindrical member 3 rests on and is pressed against the dead end portion 107 located at a deep location of the cylindrical bore 106. In this manner, the glow plug 1 is mounted onto the cylinder head 101 while sealing against the cylinder head 101. At the same time, the dead end portion 107 provided within the mounting bore 104 serves as movement prevention means for preventing movement of the metallic, cylindrical member 3 into the cylinder head 101.

As described above, according to the mounting structure of the present embodiment, the front-end-oriented end face 3*t* of the cylindrical member 3 is disposed at the dead end portion 107 such that further movement toward the glow plug front end is prevented; i.e., entry into the prechamber 103 is prevented. Accordingly, the glow plug mounting structure can be such that, even when fixation of the cylindrical member 3 and the body 4 becomes loose, the cylindrical member 3 does not enter (drop into) the prechamber 103.

As will be apparently understood from the present embodiment, the present invention can reliably prevent the case where the cylindrical member 3 drops into the prechamber 103 and thus can realize fixation through press fitting whose lower limit of tolerance is set low. Therefore, the cylindrical member to which the heater is fixedly attached can be fixedly attached to the body without employment of troublesome brazing, whereby the cost of a glow plug is reduced.

Figure 6:
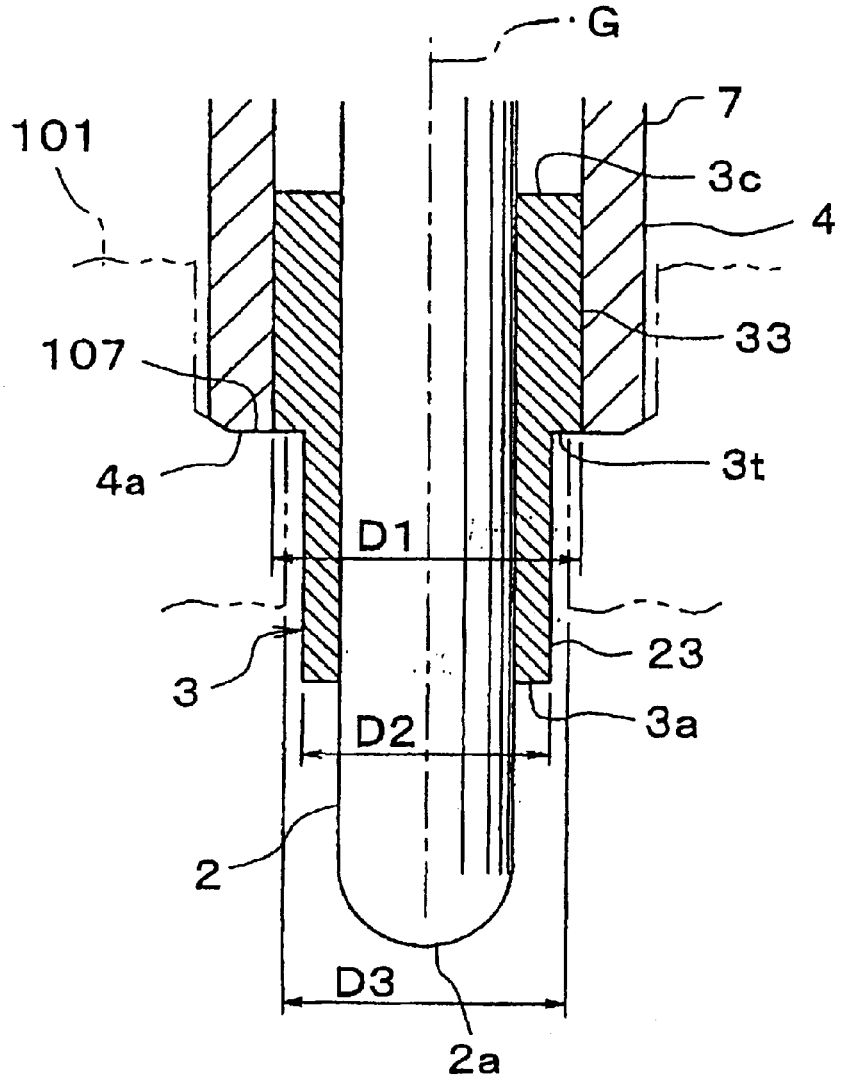
FIG. 6 is an enlarged sectional view showing a second embodiment of a glow plug according to the present invention.

The present invention is not limited to the above-described embodiment, but may be embodied as appropriate through modification of design without departing from the spirit or scope of the invention. For example, as represented by a second embodiment shown in FIG. 6, the front end 4*a* of the body 4 may assume the form of a plane perpendicular to axis G, and the front-end-oriented end face 3*t* formed in the diameter transition region of the cylindrical member 3 may also assume the form of a plane perpendicular to axis G. As shown in FIG. 6, the dead end portion 107 of a mounting bore formed in a cylinder head may also assume the form of a plane, so that the front end 4*a* of the body 4 and the front-end-oriented end face 3*t* of the metallic, cylindrical member 3 can be pressed against the dead end portion 107 while being aligned with each other. Notably, the second embodiment shown in FIG. 6 differs from the above-described embodiment only in the above-described structural feature. Therefore, portions similar to those in FIGS. 1 to 4 are denoted by common reference numerals, and repeated description thereof is omitted. This also applies to embodiments to be described below.

Figure 7:
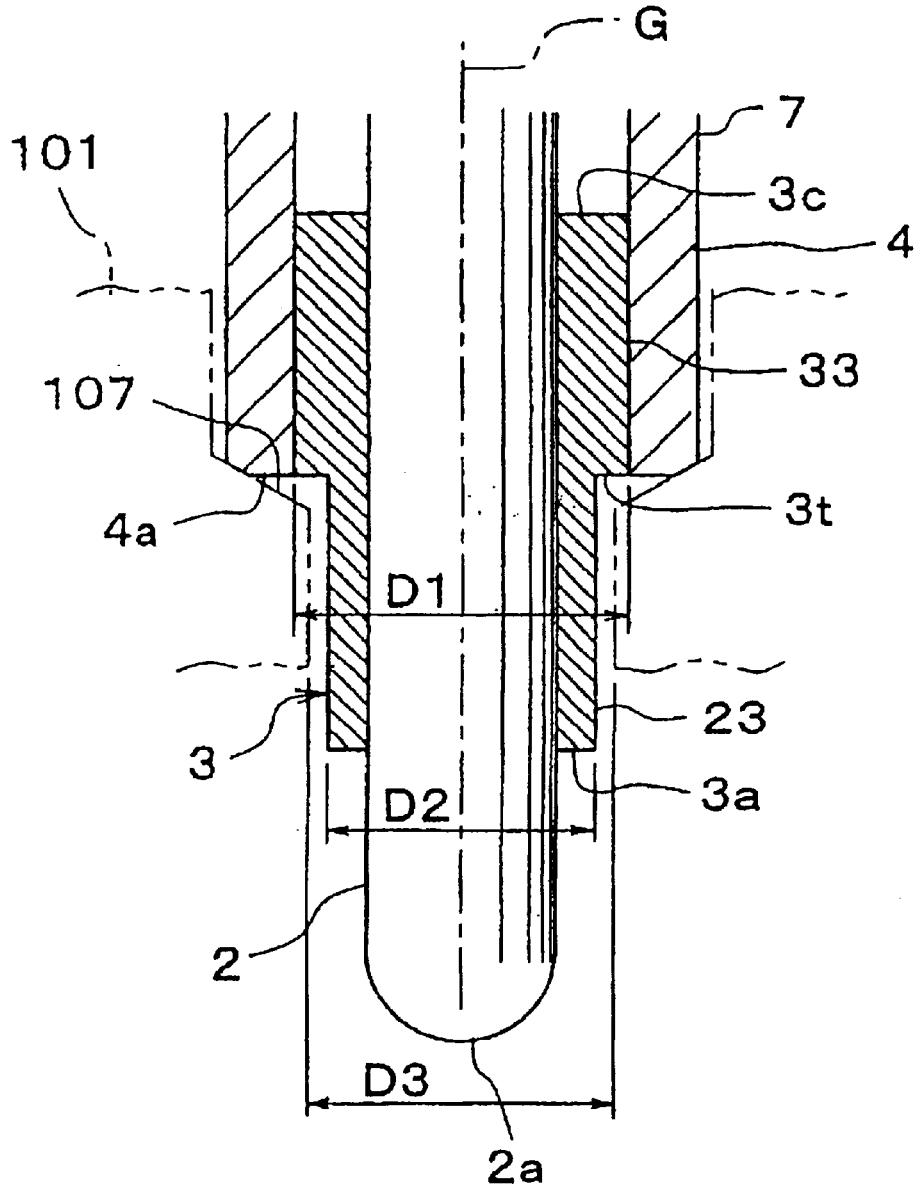
FIG. 7 is an enlarged sectional view showing a third embodiment of a glow plug according to the present invention.

The glow plug shown in FIG. 6 may be configured such that, as in the case of a third embodiment shown in FIG. 7, the dead end portion 107 of the mounting bore is tapered as described above in relation to the first embodiment. In this mounting structure, in a normal state, the front-end-oriented end face 3*t* of the cylindrical member 3 is not pressed against the dead end portion 107. When, as a result of loosening at a joint between the body 4 and the cylindrical member 3, the front-end-oriented end face 3*t* of the cylindrical member 3 moves to the dead end portion 107, further movement toward the glow plug front end is prevented, whereby entry into the interior of the cylinder head is prevented.

Figure 8:
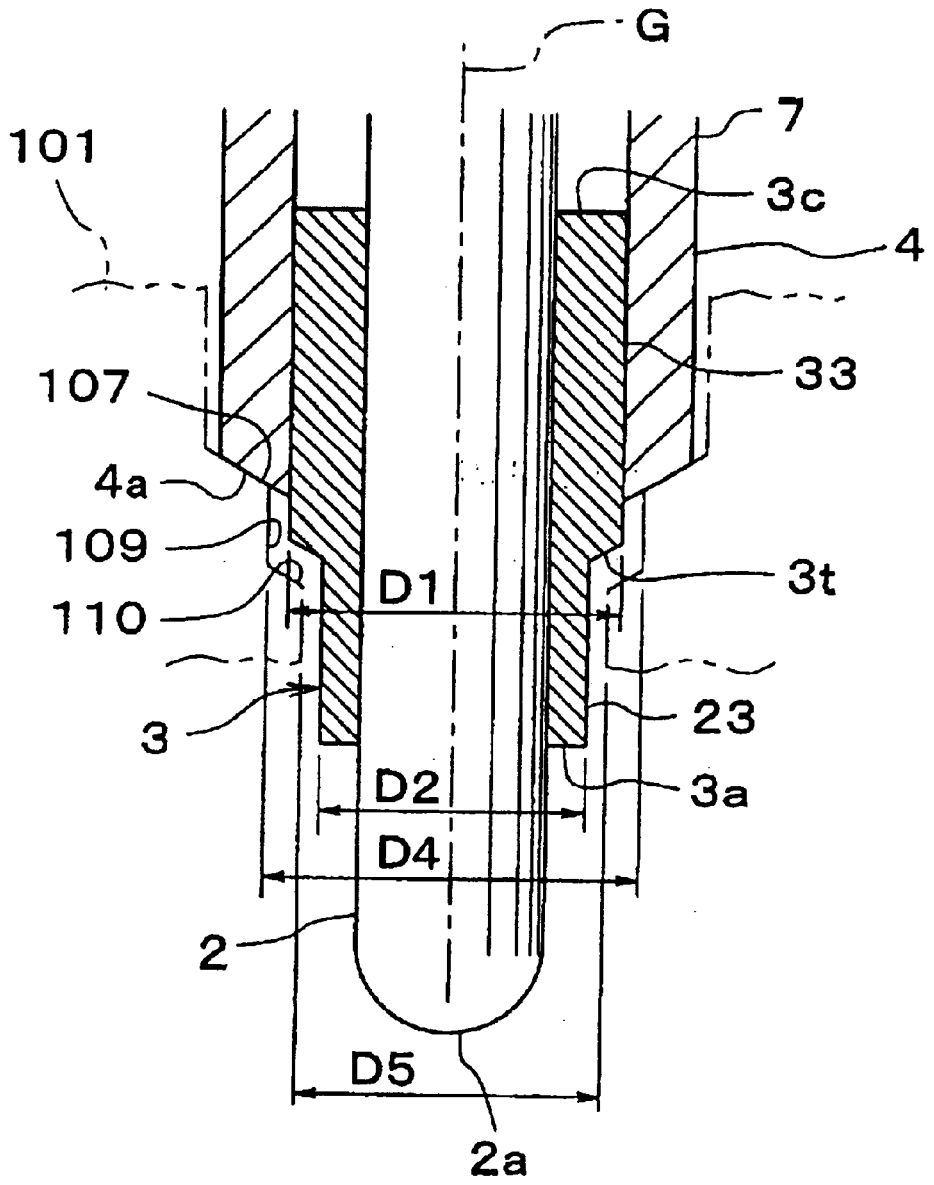
FIG. 8 is an enlarged sectional view showing a fourth embodiment of a glow plug according to the present invention.
Figure 9:
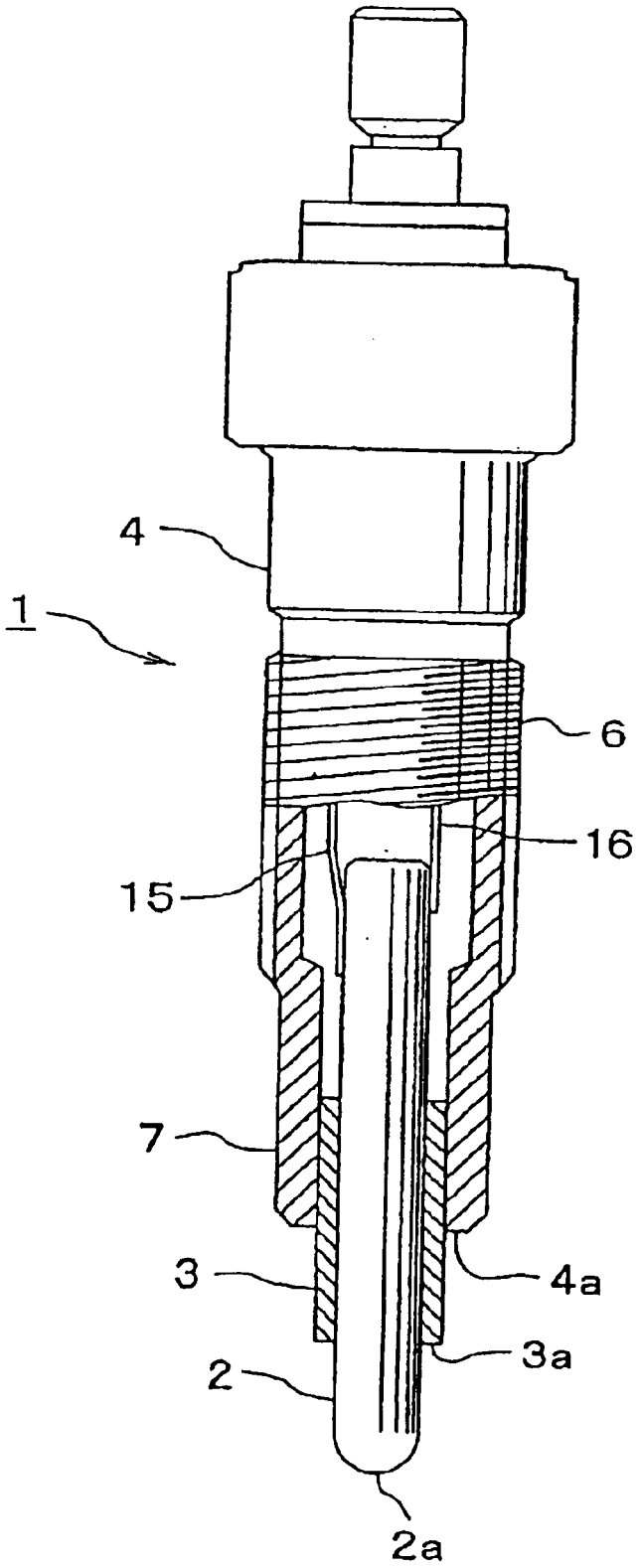
FIG.9 PRIOR ART
FIG. 9 is a front longitudinal cross section showing a conventional glow plug.
Figure 10:
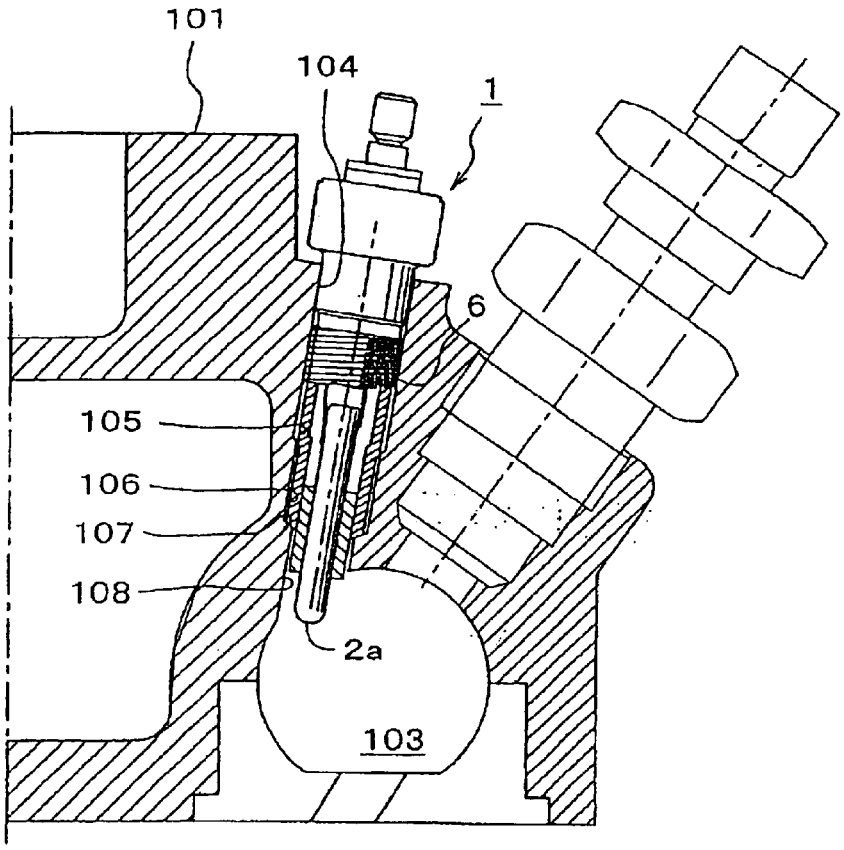
FIG.10 PRIOR ART
FIG. 10 is an explanatory view showing a state in which the glow plug of FIG. 9 is mounted on a cylinder head.
Figure 11:
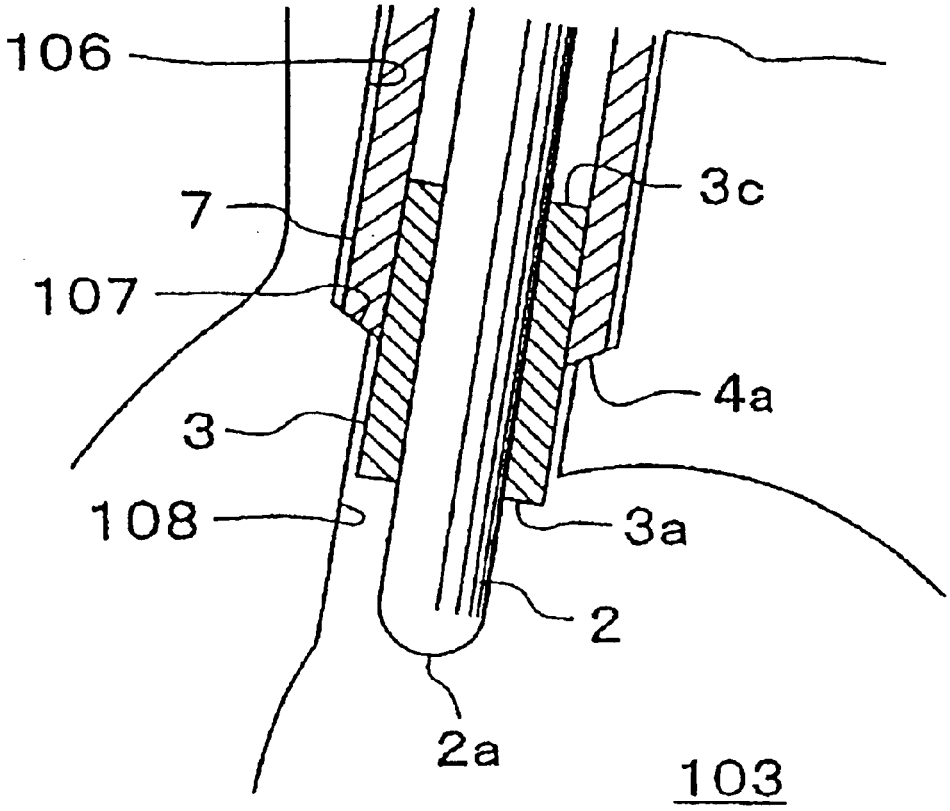
FIG.11 PRIOR ART
FIG. 11 is an enlarged view showing essential portions of FIG. 10.

As understood from the mounting structure of FIG. 7, the mounting structure may be such that, as in the case of a fourth embodiment shown in FIG. 8, the front-end-oriented end face 3*t* of the cylindrical member 3 is located ahead of the front end 4*a* of the body 4 toward the glow plug front end in the direction of axis G. According to the mounting structure of the fourth embodiment, the front end 4*a* of the body 4 is pressed against the dead end portion 107, whereas the front-end-oriented end face 3*t* of the cylindrical member 3 is located deeper than the dead end portion 107 and disposed within an intermediate bore 109, whose diameter D4 is greater than outside diameter D1 of the large-diameter portion 33 of the cylindrical member 3. Diameter D5 of a deep portion of the intermediate bore 109 is set smaller than outside diameter D1 of the large-diameter portion 33 of the cylindrical member 3. As a result, a rear-end-oriented end face 110 is formed at a deep location of the intermediate bore 109 and serves as movement prevention means for preventing the front-end-oriented end face 3*t* from moving deep. In FIG. 8, in a normal state, the front-end-oriented end face 3*t* of the cylindrical member 3 is not pressed against the rear-end-oriented end face 110. When, as a result of loosening at a joint between the body 4 and the cylindrical member 3, the front-end-oriented end face 3*t* of the cylindrical member 3 moves to the rear-end-oriented end face 110, further movement toward the glow plug front end is prevented.

That is, the structure for mounting a ceramic glow plug on a cylinder head of the present invention may be such that movement prevention means for preventing the front-end-oriented end face of a metallic, cylindrical member from moving deep into the mounting bore is provided in the mounting bore so as to prevent the metallic, cylindrical member from moving deep into the mounting bore and then into the interior of the cylinder head.

The above embodiments are described while mentioning press fit of the cylindrical member united with the heater into the body. However, the present invention can also be embodied such that a metallic, cylindrical member is fixedly disposed within a metallic, cylindrical plug body via a brazing metal. Notably, such fixation may be effected in the following manner. A cylindrical member joined with a ceramic heater is loosely fitted into a cylindrical portion of a body. Then, a heated, molten brazing metal (e.g., silver brazing metal) is poured into the gap therebetween, followed by cooling for solidification.

As understood from the above description, the glow plug of the present invention readily provides a glow plug mounting structure such that, even when loosening arises at a joint between a body and a cylindrical member after the glow plug is mounted onto a cylinder head, an assembly consisting of the cylindrical member and a ceramic heater is prevented from dropping off the body and entering an engine (prechamber). Such a mounting structure reliably prevents an assembly consisting of a cylindrical member and a heater from dropping off a body and entering an engine (prechamber) regardless of means for joining the body and the cylindrical member.

This application is based on Japanese Patent Application No. 2001-077151 filed Mar. 16, 2001, the disclosure of which is incorporated herein by reference in its entirety.

What is claimed is:

1. A ceramic glow plug in which a ceramic heater is fixedly disposed in a metallic, cylindrical member such that a front end thereof projects from a front end of the metallic, cylindrical member, and a resultant assembly consisting of the ceramic heater and the metallic, cylindrical member is fixedly disposed in a metallic, cylindrical plug body such that the front end of the metallic, cylindrical member projects from a front end of the metallic, cylindrical plug body, wherein a first portion of the metallic, cylindrical member which projects from the front end of the metallic, cylindrical plug body and extends over a predetermined range from the front end of the metallic, cylindrical member toward a rear end of the metallic, cylindrical member is smaller in outside diameter than a second portion of the metallic, cylindrical member which is fixedly disposed within the metallic, cylindrical plug body, said metallic, cylindrical member has a diameter transition region where the outside diameter changes between those of the first and second portions, and a front-end-oriented end face is formed in the diameter transition region.

2. The ceramic glow plug as claimed in claim 1, wherein the front-end-oriented end face formed in the diameter transition region of the metallic, cylindrical member and the front end of the metallic, cylindrical plug body are substantially aligned with each other in an axial direction of the ceramic heater.

3. The ceramic glow plug as claimed in claim 1, wherein a difference in outside diameter between a small-diameter portion of the metallic, cylindrical member and a large-diameter portion of the metallic, cylindrical member is not less than 0.3 mm, the small-diameter portion being located on a side toward the front end with respect to the front-end-oriented end face, which is formed in the diameter transition region of the metallic, cylindrical member, and the large-diameter portion being located on a side toward the rear end with respect to front-end-oriented end face.

4. The ceramic glow plug as claimed in claim 1, wherein the metallic, cylindrical member is press-fitted into the metallic, cylindrical plug body.

5. The ceramic glow plug as claimed in claim 1, wherein the metallic, cylindrical member is fixedly disposed in the metallic, cylindrical plug body via a brazing metal.

6. A structure for mounting a ceramic glow plug on a cylinder head configured such that a ceramic glow plug, in which a ceramic heater is fixedly disposed in a metallic, cylindrical member such that a front end thereof projects from a front end of the metallic, cylindrical member, and a resultant assembly consisting of the ceramic heater and the metallic, cylindrical member is fixedly disposed in a metallic, cylindrical plug body such that the front end of the metallic, cylindrical member projects from a front end of the metallic, cylindrical plug body, is mounted onto a cylinder head via a threaded portion formed on an outer circumferential surface of the metallic, cylindrical plug body so as to be screwed into a threaded portion of a ceramic glow plug mounting bore formed in the cylinder head until the front end of the metallic, cylindrical plug body is pressed against a dead end portion located at a deep location of the mounting bore and having a bore diameter smaller than a thread diameter of the threaded portion of the mounting bore, wherein a first portion of the metallic, cylindrical member which projects from the front end of the metallic, cylindrical plug body and extends over a predetermined range from the front end of the metallic, cylindrical member toward a rear end of the metallic, cylindrical member is smaller in outside diameter than a second portion of the metallic, cylindrical member which is fixedly disposed within the metallic, cylindrical plug body, said metallic, cylindrical member has a diameter transition region where the outside diameter changes between those of the first and second portions, and a front-end-oriented end face is formed in the diameter transition region, and the structure for mounting a ceramic glow plug on a cylinder head comprises movement prevention means provided in the mounting bore for preventing movement of the front-end-oriented end face deep into the mounting bore so as to prevent the metallic, cylindrical member from moving deep into the mounting bore and into interior of the cylinder head.

7. The structure for mounting a ceramic glow plug on a cylinder head as claimed in claim 6, wherein the movement prevention means is implemented by rendering the bore diameter of the dead end portion of the mounting bore smaller than an outside diameter of a large-diameter portion having a relatively large diameter and being located on a side toward the rear end with respect to the front-end-oriented end face.

8. The structure for mounting a ceramic glow plug on a cylinder head as claimed in claim 6, wherein the movement prevention means is implemented by rendering a diameter of the mounting bore, measured at a location located deeper than the dead end portion, smaller than an outside diameter of a large-diameter portion having a relatively large diameter and being located on a side toward the rear end with respect to the front-end-oriented end face.

9. A ceramic glow plug in which a ceramic heater is fixedly disposed in a metallic, cylindrical member such that a front end thereof projects from a front end of the metallic, cylindrical member, and a resultant assembly consisting of the ceramic heater and the metallic, cylindrical member is fixedly disposed in a metallic, cylindrical plug body such that the front end of the metallic, cylindrical member projects from a front end of the metallic, cylindrical plug body, wherein a first portion of the metallic, cylindrical member which projects from the front end of the metallic, cylindrical plug body and extends over a predetermined range from the front end of the metallic, cylindrical member toward a rear end of the metallic, cylindrical member is smaller in outside diameter than a second portion of the metallic, cylindrical member which is fixedly disposed within the metallic, cylindrical plug body, said metallic, cylindrical member has a diameter transition region where the outside diameter changes between those of the first and second portions, and a front-end-oriented end face is formed in the diameter transition region of the metallic, cylindrical member and is disposed within the metallic, cylindrical plug body.

10. A ceramic glow plug in which a ceramic heater is fixedly disposed in a metallic, cylindrical member such that a front end thereof projects from a front end of the metallic, cylindrical member, and a resultant assembly consisting of the ceramic heater and the metallic, cylindrical member is fixedly disposed in a metallic, cylindrical plug body such that the front end of the metallic, cylindrical member projects from a front end of the metallic, cylindrical plug body, wherein a first portion of the metallic, cylindrical member which projects from the front end of the metallic, cylindrical plug body and extends over a predetermined range from the front end of the metallic, cylindrical member toward a rear end of the metallic, cylindrical member is smaller in outside diameter than a second portion of the metallic, cylindrical member which is fixedly disposed within the metallic, cylindrical plug body, said metallic, cylindrical member has a diameter transition region where the outside diameter changes between those of the first and second portions, and a front-end-oriented end face is formed in the diameter transition region of the metallic, cylindrical member and is disposed within a tapered front end of the metallic, cylindrical plug body.

* * * * *